US011607890B2

(12) United States Patent
Gracia Verdugo et al.

(10) Patent No.: US 11,607,890 B2
(45) Date of Patent: Mar. 21, 2023

(54) PRINT FLUIDS REFILLS

(71) Applicant: HEWLETT-PACKARD DEVELOPMENT COMPANY, L.P., Spring, TX (US)

(72) Inventors: Antonio Gracia Verdugo, Sant Cugat del Valles (ES); Ana Oropesa Fisica, Sant Cugat del Valles (ES); Dorkaitz Alain Vazquez Fernandez, Sant Cugat del Valles (ES); Josep Ortiz Mompel, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 84 days.

(21) Appl. No.: 17/212,809

(22) Filed: Mar. 25, 2021

(65) Prior Publication Data

US 2022/0305801 A1 Sep. 29, 2022

(51) Int. Cl.
*B41J 2/175* (2006.01)

(52) U.S. Cl.
CPC .. *B41J 2/17566* (2013.01); *B41J 2002/17569* (2013.01)

(58) Field of Classification Search
CPC ..... B41J 2/17566; B41J 2002/17569
See application file for complete search history.

(56) References Cited

U.S. PATENT DOCUMENTS

| | | | | |
|---|---|---|---|---|
| 6,260,941 | B1 | 7/2001 | Su et al. | |
| 6,676,237 | B2 | 1/2004 | Kobayashi et al. | |
| 2008/0252700 | A1 | 10/2008 | Silverbrook | |
| 2017/0144448 | A1 * | 5/2017 | Smith | B41J 2/175 |
| 2020/0180319 | A1 | 6/2020 | Janssen et al. | |

FOREIGN PATENT DOCUMENTS

| | | | | |
|---|---|---|---|---|
| FR | 2954215 A1 * | 6/2011 | | B41J 2/02 |
| JP | 2004519362 A * | 7/2004 | | |
| JP | 2018062123 A | 4/2018 | | |

* cited by examiner

*Primary Examiner* — Sharon Polk

(57) ABSTRACT

Aspects of the disclosure provide an electronic device comprising a controller. The controller to determine a volume of print fluid in a first tank of the electronic device, monitor current printing conditions of the electronic device disposing print fluid on a substrate, determine, based on the volume of print fluid and the current printing conditions, whether an adverse printing condition exists, responsive to the volume of print fluid being less than a threshold and the adverse printing condition not existing, control a pump to refill the first tank from a second tank at a flow rate determined at least partially according to the determined volume, and responsive to the volume of print fluid being less than the threshold and the adverse printing condition existing, control the pump to refill the first tank from the second tank at a default flow rate determined independent of the determined volume.

19 Claims, 6 Drawing Sheets

PRINT FLUIDS REFILLS

BACKGROUND

Some print systems include multiple ink tanks or reservoirs. Some of the tanks may be larger than other of the tanks. For example, an intermediate tank may be a component of the print system and be incorporated into, or coupled to, a structure of the print system. In some examples, the intermediate tank is enclosed by, or otherwise incorporated into, a housing of the print system. An external tank may be located proximate to the structure of the print system, but not be incorporated in the structure of the print system. For example, the external tank may sit on the ground near the structure of the print system and be coupled to the intermediate tank via tubing suitable for facilitating a flow of print liquid, such as a printer ink, pre-printing fluid, post-printing fluid, etc. The external tank may have a volume greater than the intermediate tank.

BRIEF DESCRIPTION OF THE DRAWINGS

Various examples are described below referring to the following figures.

DETAILED DESCRIPTION

Figure 1:
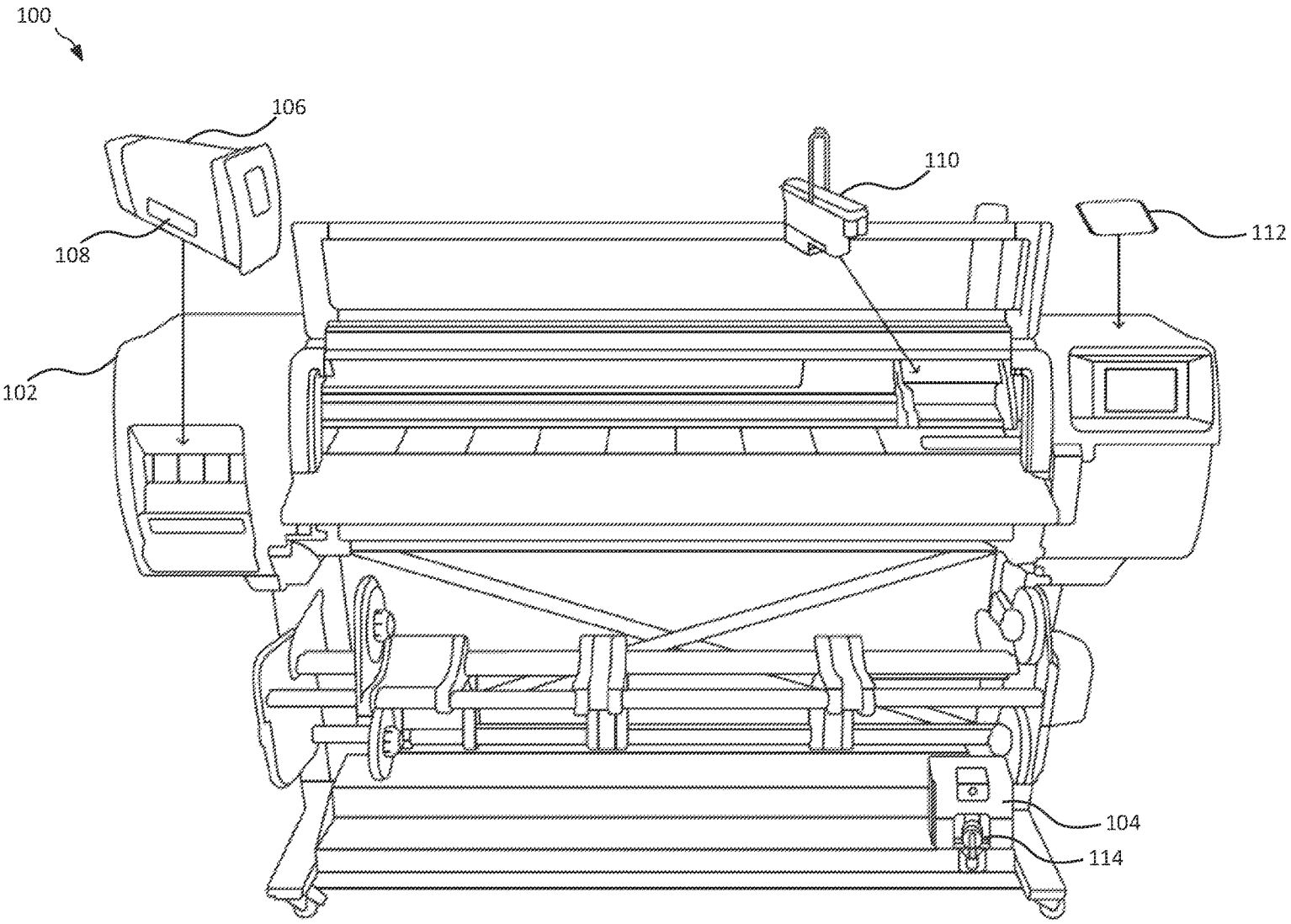
FIG. 1 is a perspective view diagram of a print system in accordance with various examples.

As a print system disposes print fluid (e.g., such as printer ink) on a substrate (e.g., as the print system performs printing), the print system consumes printer fluid from the intermediate tank, as described above. The intermediate tank may have a threshold volume associated with it, such that the print system seeks to maintain an amount of print fluid in the intermediate tank greater than the threshold volume. In some examples, the print system estimates the volume of print fluid in the intermediate tank based on a downward pressure exerted by the print fluid in the intermediate tank on a pressure sensor. In response to determining that the volume of print fluid in the intermediate tank is less than the threshold volume, the print system may pump print fluid from an external tank, as described above, to the intermediate tank to replenish the volume of print fluid in the intermediate tank to be greater than the threshold volume.

Some conditions may affect an accuracy of replenishment of the intermediate tank. For example, if the print system is engaged in disposing a large density of print fluid on a substrate, if signal noise exists in the pressure measurement of the intermediate tank, etc., an accuracy of the replenishment or refilling may be affected and a flow rate of print fluid from the external tank to the intermediate tank may be incorrect, resulting in overfilling or underfilling of the intermediate tank. Overfilling or underfilling of the intermediate tank may, in some examples, detrimentally affect operation of the print system, such as by resulting in an unknown volume of print fluid remaining in the external tank.

This disclosure describes a print system that monitors a status of a print fluid supply. The monitoring is performed, in some examples, based on measuring a pressure exerted by the print fluid on a pressure sensor positioned beneath the print fluid (e.g., such as beneath an intermediate tank in which the print fluid is stored). If the measured pressure is less than a threshold, the print system may begin a refilling process in which the print system transfers (e.g., pumps) print fluid from an external tank to the intermediate tank. The print fluid may be transferred from the external tank to the intermediate tank according to a predetermined flow rate. The predetermined flow rate may be such that the print fluid is transferred from the external tank to the intermediate tank incrementally over multiple pumping cycles to bring the volume of the print fluid in the intermediate tank (e.g., as determined by the measured pressure) above the threshold.

The print system may further determine whether potentially adverse printing conditions exist, such as via densitometer measurements of ongoing printing by the print system. The print system may also determine a standard deviation and average of the measured pressure for each print cycle. Based on the densitometer output, the determined standard deviation, and the determined average, the print system may determine whether a potentially adverse printing condition exists. If the print system determines that a potentially adverse printing condition does not exist, the print system determines that the predetermined flow rate for refilling the intermediate tank is accurate and continues the refilling process. The predetermined flow rate may be determined based on a programmed volume of fluid transfer per pump cycle of the refilling process and an estimated volume of print fluid in the intermediate tank.

If the print system determines that a potentially adverse printing condition does exist, the print system may disregard the measured pressure in determining a flow rate for refilling the intermediate tank and may instead refill the intermediate tank at a default flow rate. The default flow rate may be a flow rate specified by a manufacturer of the print system (e.g., a "known good" flow rate) that may be free of influence from noise existing in measurements of signal transmission of the print system, printing conditions of the print system, etc. In other examples, the default flow rate may be programmed by a user or determined by the print system based on a calibration function of the print system. Print fluid consumed from the external tank during a pump cycle of the refilling process may be recorded by the print system and, in some examples, reported to a user interface or display screen. Subsequent to the recording of the consumed print fluid, the print system may begin another pump cycle of the refilling process, monitoring the status of the print fluid supply.

FIG. 1 shows a diagram of an example print system 100. In at least some examples, the print system 100 may include a printer 102 and tank 104. The printer 102 may include an intermediate tank 106, a sensor 108, a print head 110, and a control board 112. In at least some examples, the print system 100 also includes a pump 114.

In at least some examples, the printer 102 transfers a print fluid, such as ink, from the intermediate tank 106 to the print head 110 for application on a substrate (not shown). In other examples, the print fluid may be a treatment fluid (e.g., pre- and/or post-printing fluid, a finishing fluid, etc.), or any other suitable fluid capable of being deposited or disposed on the substrate by the print head 110. The print head 110 may apply the print fluid to the substrate as an array or matrix of small dots of print fluid according to a pattern determined by the printer 102 (e.g., such as via the control board 112) or a pattern received by the printer 102 (e.g., such as from a computing device (not shown)). The print head 110 may deposit the print fluid on the substrate by any suitable process, such as a continuous ink system or process, a drop-on-demand process, a dye sublimation process, etc.

A volume of print fluid in the intermediate tank 106 may be monitored by the sensor 108. In some examples, the sensor 108 is a pressure senor affixed to the intermediate tank 106 at a bottom of the intermediate tank 106. For example, the sensor 108 may be affixed to the intermediate tank 106 such that a downward force is applied to the sensor 108, the downward force having a value proportional to the volume of print fluid contained in the intermediate tank 106. As the volume of print fluid contained in the intermediate tank 106 decreases, so too may a value of the downward force exerted on the sensor 108 (e.g., the measured pressure). Conversely, as the volume of print fluid contained in the intermediate tank 106 increases, so too may the measured pressure. In at least some examples of the print system 100, responsive to the measured pressure decreasing below a threshold, the print system 100 transfers print fluid from the tank 104 to the intermediate tank 106. For example, the pump 114 may pump print fluid from the tank 104 to the intermediate tank 106. Generally, the tank 104 may have a larger volume than the intermediate tank 106. For example, the tank 104 may be a high-volume reservoir.

Some printing jobs may involve the print head 110 depositing a larger density of print fluid on the substrate than other printing jobs. For example, the print head 110 may traverse the substrate linearly across a first dimension of the substrate (or across a portion of the first dimension upon which the print head 110 will deposit print fluid) depositing print fluid. Subsequent to completing its movement across the first dimension, the printer 102 may advance the substrate along a second dimension of the substrate. This advancement may facilitate the print head 110 again traversing the substrate linearly across the first dimension of the substrate depositing additional print fluid on at least some areas of the substrate which have not previously received print fluid. A single pass of the print head 110 along the substrate in the first dimension may be referred to as a printing or print swath.

The print head 110, or the printer 102, may include a sensor (not shown) that monitors, measures, and/or estimates a density of print fluid being deposited by the print head 110 for a given printing swath. For example, the print head 110, or the printer 102, may include a densitometer (not shown) that analyzes, per printing swatch, an amount of print fluid deposited by the print head 110 on the substrate. Based on the density of print fluid being deposited by the print head 110, the printer 102 (e.g., such as via the control board 112) may determine an amount of print fluid flowing through the print head 110 from the intermediate tank 106. The amount of print fluid flowing through the print head 110 may be referred to as a print fluid flux, and may be provided in units of volume per period of time. A sustained print fluid flux of the printer 102 (with respect to the print head 110) exceeding a threshold may result in what may be referred to as an adverse printing condition or difficult printing job. In at least some examples of the print system 100, infrequent printing jobs involving adverse printing conditions may not pose a particular challenge to the print system 100. For example, few and infrequent printing jobs including adverse printing conditions during a day full of printing jobs may result in some error in the refilling process such that an expected volume of print fluid in the tank 104 may vary from an actual volume of print fluid in the tank 104, but not by a significant or material amount relative to a capacity of the tank 104. However, a printing job including adverse printing conditions existing for an extended period of time, or printing jobs including adverse printing conditions occurring frequently during a day full of printing jobs, may result in each of the small errors described herein accumulating to a significant or material amount relative to the capacity of the tank 104 such that operation of the print system 100 may be adversely affected by the cumulative error (e.g., such as falsely reporting that the tank 104 is exhausted, etc.).

In at least some examples, as described above, challenges may arise in the print system 100 replenishing print fluid in the intermediate tank 106 from the tank 104, such as responsive to a sustained print fluid flux of the printer 102 exceeding the threshold and results in an adverse printing condition. During a printing job including an adverse printing condition, the sensor 108 may report data to the control board 112, or the control board 112 may derive information from data received from the sensor 108, that is inaccurate. For example, a signal provided by the sensor 108 to the control board 112 may be noisy, or include rapidly fluctuating values. In at least some examples, a standard deviation of the signal provided by the sensor 108 to the control board 112 exceeding a threshold amount may also, or alternatively, be an indication of an adverse printing condition. In at least some examples, the threshold may be the standard deviation having changed twenty percent or more from an immediately preceding determined standard deviation. Based on this inaccurate data, the control board 112 may report incorrect information to a user, such as incorrectly reporting that the intermediate tank 106 and/or the tank 104 is out of print fluid, reporting an issue with the sensor 108, etc. The control board 112 may also act on the inaccurate data in a manner which may be detrimental to operation of the printer 102 and/or print system 100. For example, based on the inaccurate data the control board 112 may control the pump 114 to transfer print fluid from the tank 104 to the intermediate tank 106, but the amount of print fluid transferred may be more than, or less than, actually should be transferred if the inaccurate data were instead accurate. This may result in the printer 102, such as via the control board 112, reporting an inaccurate consumption of print fluid. In some examples, the inaccuracy may be with regard to print fluid flowing through the print head 112 and/or print fluid remaining in the tank 104.

Responsive to detection or determination of the adverse printing condition, the control board 112 may modify operation of the printer 102. For example, the control board 112 may control the printer 102 to slow a print speed of the printer 102, may pause an automatic refilling process for transferring print fluid from the tank 104 to the intermediate tank 106 and prompt a user to perform a manual refilling, may pause the printing job including the adverse printing condition to perform the automatic refilling process for transferring print fluid from the tank 104 to the intermediate tank 106, or may modify the automatic refilling process for transferring print fluid from the tank 104 to the intermediate tank 106 to use estimated values rather than measured or calculated values.

In at least one example, the modified automatic refilling process may disregard output data of the sensor 108 in determining a flow rate for refilling the intermediate tank 106. As used herein, the flow rate may be a volume of print fluid to be transferred to the intermediate tank 106 per pump cycle of the pump 114 for a number of pump cycles to be performed by the pump 114. For example, as described above, the adverse printing condition may result in the output signal of the sensor 108 being noisy. The noise of the output signal may result in false determinations with respect to threshold values. For example, the control board 112 may falsely determine that the refilling process should begin or falsely determine that the refilling process should end, such as by falsely determining that a first volume of print fluid has been transferred to the intermediate tank 106 when instead a volume of print fluid less than the first volume has in fact been transferred to the intermediate tank 106. In an example of such false determinations, responsive to the output signal reaching a first threshold, the control board 112 may control the pump 114 to pump a programmed volume of print fluid (or pump print fluid at a programmed pressure for a programmed number of seconds) to the intermediate tank 106 for a determined number of pump cycles. In another example, responsive to the output signal reaching a first threshold, the control board 112 may control the pump 114 to pump a determined volume of print fluid (or pump print fluid at a programmed pressure for a determined number of seconds) to the intermediate tank 106 for a programmed number of pump cycles. Responsive to the output signal reaching a second threshold, the control board 112 may determine that the refilling process is completed, even if the programmed or determined number of pump cycles has not been performed. Because of the noise in the output signal, the first threshold and/or the second threshold may be reached prematurely or erroneously, such as resulting from the noise of the output signal and not from a measurement of an actual volume of print fluid in the intermediate tank 106.

By modifying the automatic refilling process to disregard the output signal of the sensor 108 in determining the flow rate for refilling the intermediate tank 106, the control board 112 may prevent the noise of the output signal from adversely affecting the automatic refilling process and/or operation of the printer 102. In at least some examples, while disregarding the output signal of the sensor 108 in determining the flow rate, the control board 112 may implement the automatic refilling process according to a default flow rate. The default flow rate may be determined independent of a value of the output signal of the sensor 108. For example, the default flow rate may be a flow rate determined as a known good flow rate. In various examples, the default flow rate may be programmed by a user as a flow rate to use in the event of existence of an adverse printing condition, a flow rate to use in the event of existence of an adverse printing condition as determined according to a calibration process of the print system 100, a flow rate pre-programmed by a manufacturer of the printer 102 (or other third-party deemed sufficiently expert in operation of the print system 100 to pre-program a flow rate), etc.

In at least some examples, the control board 112 may reevaluate the output signal of the sensor 108 per pump cycle to determine whether the standard deviation of the output signal continues to exceed the threshold for existence of the adverse printing condition. If the control board 112 determines the adverse printing condition to still exist, the control board 112 may continue to disregard the output signal in determining a flow rate for controlling the pump 114 to refill the intermediate tank 106. If the control board 112 instead determines the adverse printing condition no longer exists, the control board 112 may recalculate or determine a flow rate for refilling the intermediate tank 106 based at least partially on a value of the output signal and may control the pump 114 according to the recalculated flow rate.

While this disclosure refers to one intermediate tank 106 and one tank 104, implementations of the print system 100 may include any number of intermediate tanks 106 and tanks 104, where at least one tank 104 exists for each intermediate tank 106. In some examples, a number of intermediate tanks 106 of the printer 102 may correspond to a number of unique colors of print fluid, such as cyan, magenta, yellow, black, and sometimes white, or unique print fluids, that the printer 102 may use in a printing job. Similarly, while this disclosure refers to one print head 110, implementations of the printer 102 may include any number of print heads 110. In some examples, each intermediate tank 106 may be uniquely associated with a print head 110. In other examples, a print head 110 may be associated with more than one intermediate tank 106. The teachings of this disclosure are equally applicable to these implementations of multiple tanks 104, intermediate tanks 106, and/or print heads 110.

Figure 2A:
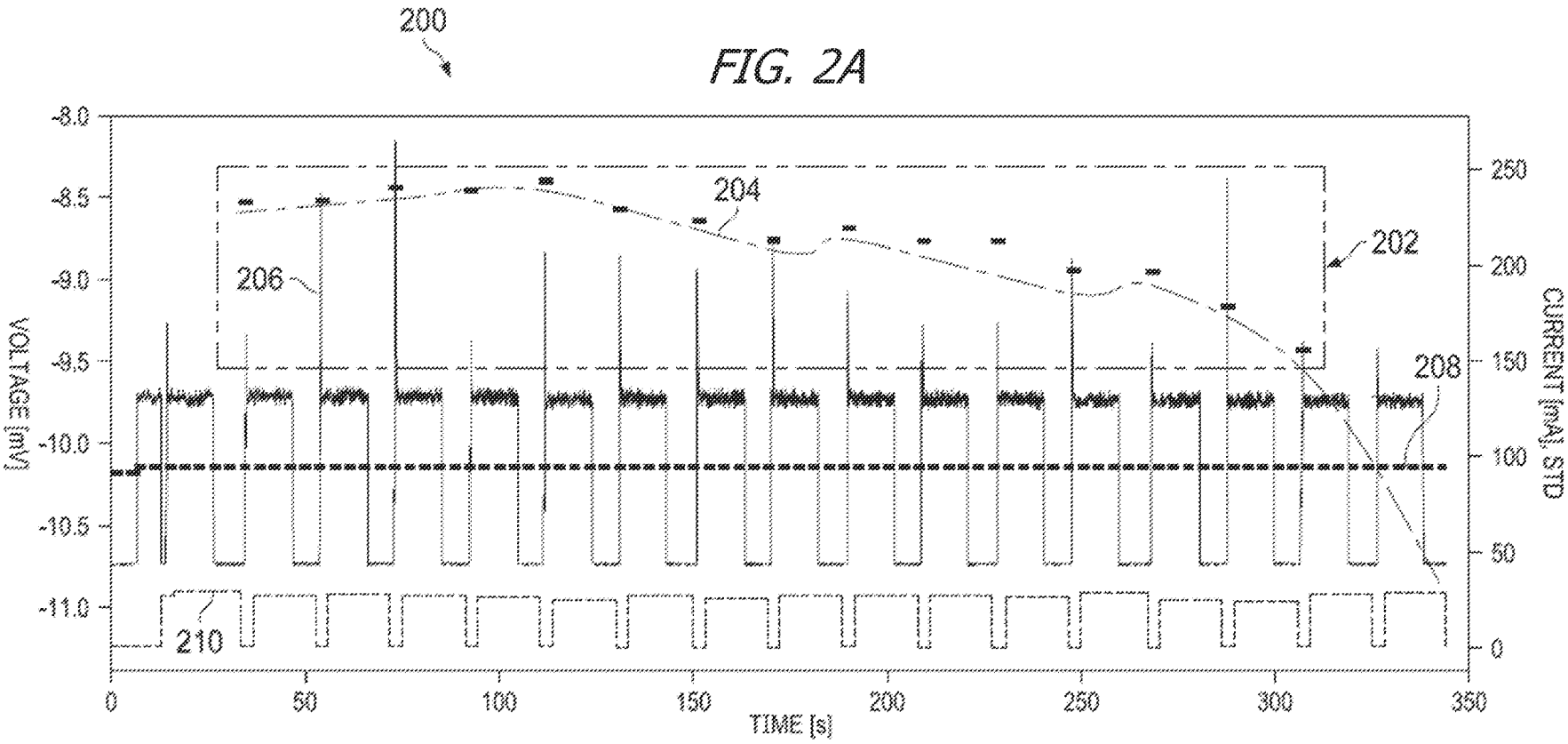
FIG. 2A is a diagram of signals in accordance with various examples.
Figure 2B:
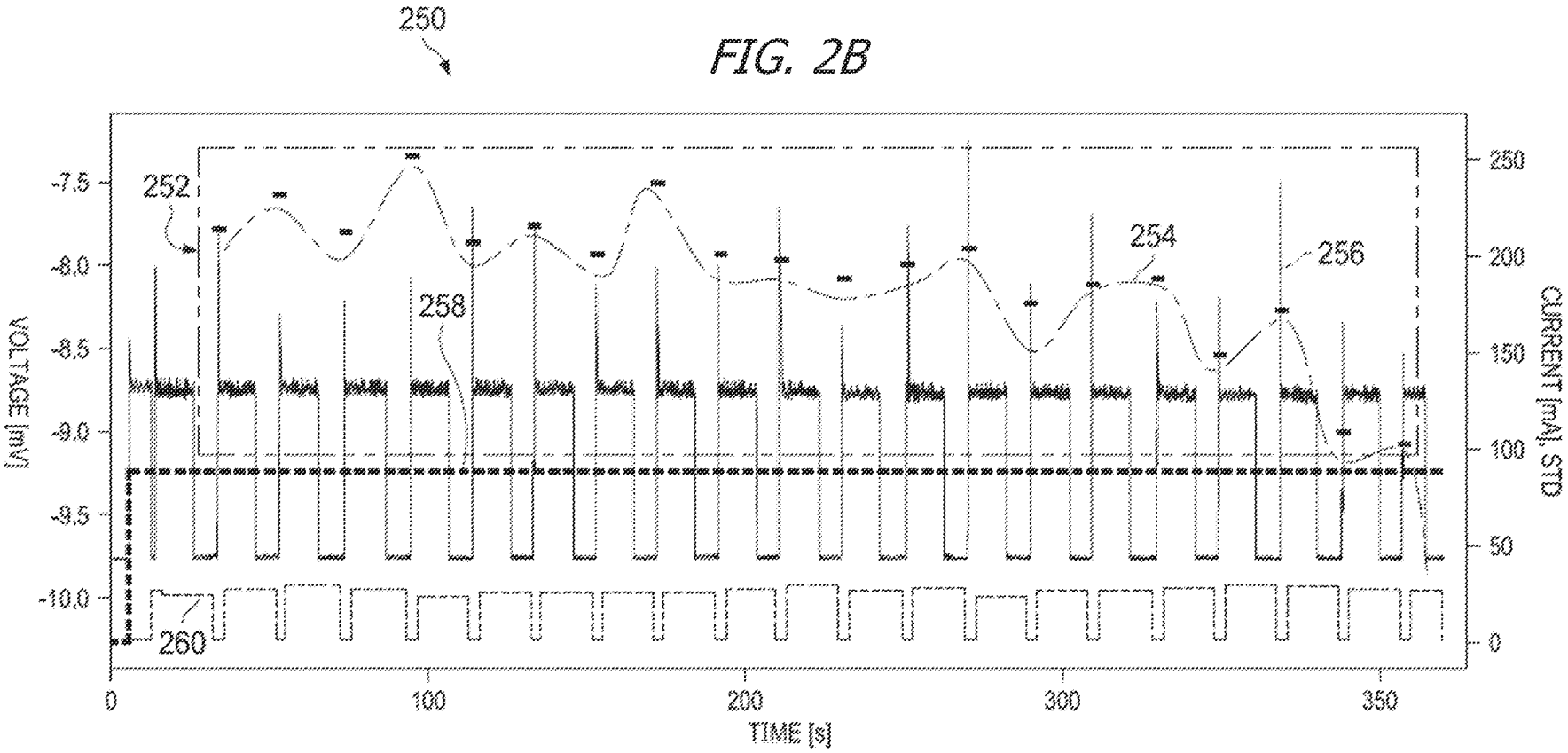
FIG. 2B is a diagram of signals in accordance with various examples.

FIGS. 2A and 2B are diagrams 200 and 250, respectively, of example signals. The signals of diagrams 200 and 250 are illustrative of at least some signals that may be provided in some implementations of the print system 100 of FIG. 1. Accordingly, reference may be made to components of FIG. 1 in describing the diagrams 200 and 250.

The diagram 200 may be representative of at least some signals that may be provided in implementations of the print system 100 in which the printer 102 is not performing a printing job including an adverse printing condition. The diagram 250 may be representative of at least some signals that may be provided in implementations of the print system 100 in which the printer 102 is performing a printing job including an adverse printing condition.

The diagram 200 includes a signal 202 representative of an average output of the sensor 108, a signal 204 representative of the output of the sensor 108, a signal 206 representative of a current consumed by the pump 114 (e.g., where increased current indicates pumping by the pump 114), a signal 208 indicating a threshold (to be compared to the signal 204) for ending the refilling process, and a signal 210 representative of a standard deviation of the signal 204. The diagram 250 includes a signal 252 representative of an average output of the sensor 108, a signal 254 representative of the output of the sensor 108, a signal 256 representative of a current consumed by the pump 114 (e.g., where increased current indicates pumping by the pump 114), a signal 258 indicating a threshold (to be compared to the signal 254) for ending the refilling process, and a signal 260 representative of a standard deviation of the signal 254. In both the diagram 200 and the diagram 250, the signals 202, 204, 208, 252, 254, and 258 are measured against the left vertical axis which is representative of voltage in units of mV. The signals 206 and 256 are measured against the right vertical axis in units of milliamps. The signals 210 and 260 (representing a standard deviation, or STD) are measured against the right vertical axis in generic units (e.g., a 0 to 100 scale). For both the diagram 200 and the diagram 250, the horizontal axis is representative of time in units of seconds (s).

As shown by the diagram 200, while the printer 102 is not performing a printing job including an adverse printing condition, the signal 204 has a generally smoothly increasing pattern until reaching a threshold for beginning the refilling process of the intermediate tank 106 (e.g., a first threshold) and a generally smoothly decreasing pattern until reaching a threshold for ending the refilling process of the intermediate tank 106 (e.g., a second threshold), indicated in the diagram 200 as EOR_THRESHOLD. As further shown by the diagram 200, a pump cycle begins as the current consumed by the pump 114, represented by signal 206, increases to about 125 milliamps (mA) and ends as the current consumed by the pump 114 decreases to about 50 mA.

As shown by the diagram 250, while the printer 102 is performing a printing job including an adverse printing condition, the signal 254 has an erratically increasing and decreasing value, such as resulting from noise introduced to the signal 254 due at least in part to the adverse printing condition. As further shown by the diagram 250, a pump cycle begins as the current consumed by the pump 114, represented by signal 256, increases to about 125 mA and ends as the current consumed by the pump 114 decreases to about 50 mA. Comparing the diagram 200 to the diagram 200, it can be seen that when the printer 102 is performing the printing job including an adverse printing condition, the noisiness of the signal 254 at least partially causes a greater number of pump cycles to be performed (e.g., 21 as shown in the diagram 250 compared to 17 as shown in the diagram 200). In an ideal refilling process, such as one in which the noisiness of the signal 254 were not present, the diagram 250 would also include 17 pump cycles instead of 21.

Figure 3:
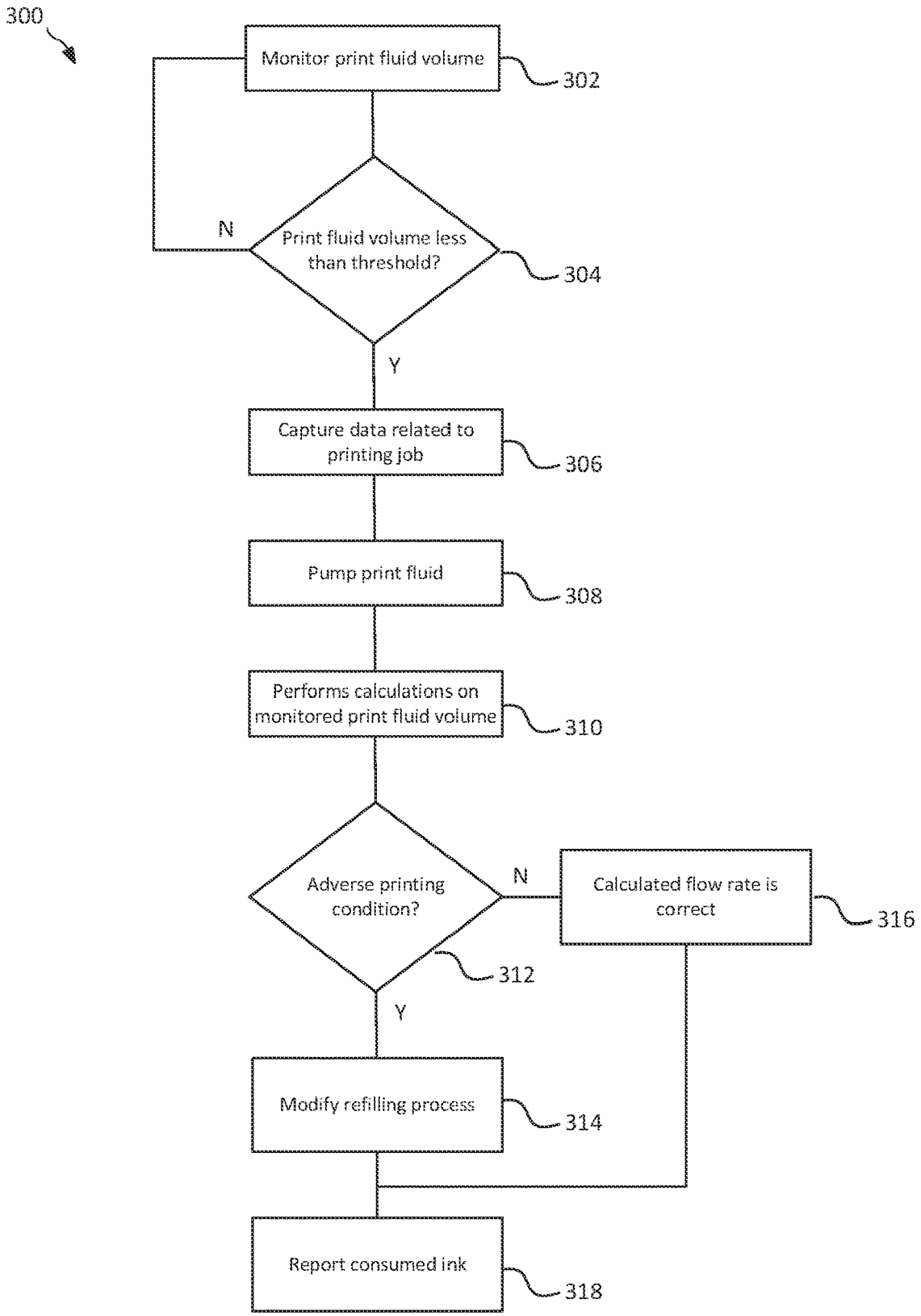
FIG. 3 is a flow diagram of a method in accordance with various examples.

FIG. 3 shows a flowchart of an example method 300. In at least some examples, the method 300 is implemented by a controller of a printer, such as the control board 112 of the printer 102 of the print system 100 of FIG. 1. Accordingly, reference may be made to components of FIG. 1 in describing the method 300. In at least some examples, the method 300 is a method for performing refilling of the intermediate tank 106, such as from the tank 104. In some examples, the method 300 is representative of a single pump cycle of the refilling process for refilling of the intermediate tank 106.

At operation 302, a signal representative of a volume of print fluid is monitored. The signal is monitored, in some examples, by the control board 112. In at least some examples, the signal may be provided by the sensor 108. The sensor 108 is, in some examples, a pressure sensor such that the signal is a signal representative of a pressure exerted on the pressure sensor.

At operation 304, the control board 112 determines whether the monitored signal (or a value or other signal derived from the signal) is less than a threshold for beginning a refilling process for refilling the intermediate tank 106 from the tank 104. If the monitored signal is not less than the threshold for beginning the refilling process, the method 300 returns to operation 302. If the monitored signal is less than the threshold for beginning the refilling process, the method 300 proceeds to operation 306.

At operation 306, the control board 112 captures data related to a printing job being performed by the printer 102. In at least some examples, the captured data includes data provided by a densitometer or other component that provides a signal that may be indicative of a volume or density of print fluid being disposed by the print head 110 on a substrate, a print fluid flux of the print head 110, etc.

At operation 308, the control board 112 controls the pump 114 to pump print fluid from the tank 104 to the intermediate tank 106. In some examples, a flow rate for pumping at operation 308 may be a fixed flow rate, such as programmed and fixed for a first pump cycle in a refiling process for pumping print fluid from the tank 104 to the intermediate tank 106. In other examples, the flow rate may be a calculated flow rate, such as calculated based at least partially on the signal monitored at operation 302. In yet other examples, the flow rate may be a programmed flow that is a known good flow rate, as described herein, such as in response to presence of the adverse printing condition, also as described herein.

At operation 310, the control board 112 may perform calculations and/or comparisons related to the signal monitored at operation 302. For example, the control board 112 may calculate a standard deviation associated with the signal, an average of the signal over a programmed period of time (e.g., such as per pump cycle of the pump 114), and/or compare the signal (or a value or other signal derived from the signal) to thresholds.

At operation 312, the control board 112 determines whether the signal monitored at operation 302, the data captured at operation 306 related to the printing job being performed by the printer 102, and the data calculated at operation 310 indicate that the printer 102 is involved in a printing job including an adverse printing condition. If the control board 112 determines that the printer 102 is involved in a printing job including an adverse printing condition, the method 300 proceeds to operation 314.

At operation 314, the control board 112 modifies the refilling process for the intermediate tank 106. For example, the control board 112 may modify the refilling process by disregarding the signal monitored at operation 302 in determining a flow rate for refilling the intermediate tank 106 form the tank 104. In other examples, the control board 112 may modify the refilling process in other manners, as described above herein. After modifying the refilling process, the method 300 may proceed to operation 318.

Returning now to operation 312, if the control board 112 determines that the printer 102 is not involved in a printing job including an adverse printing condition, the method 300 proceeds to operation 316. At operation 316, the control board 112 determines that a calculated flow rate, calculated at least partially according to the signal monitored at operation 302, is correct for use in the refilling process.

At operation 318, the control board 112 reports a volume of ink consumed during the refilling process. For example, the control board 112 may transmit data to a remote server to report the volume of print fluid consumed (such as for presentation via a cloud interface or for further processing and/or analysis), may transmit a message to a user via any suitable intranet or internet network reporting the volume of print fluid consumed, may present data reporting the volume of print fluid consumed (or a volume of ink remaining, such as in the tank 104), may control an indicator such as a light or other visual indicator, etc. In some examples, the reported print fluid consumed may be an actual or calculated consumption, such as if the printer 102 is not involved in a printing job including an adverse printing condition. In other examples, the reported print fluid consumed may be an estimate consumption, such as if the printer 102 is involved in a printing job including an adverse printing condition.

Figure 4:
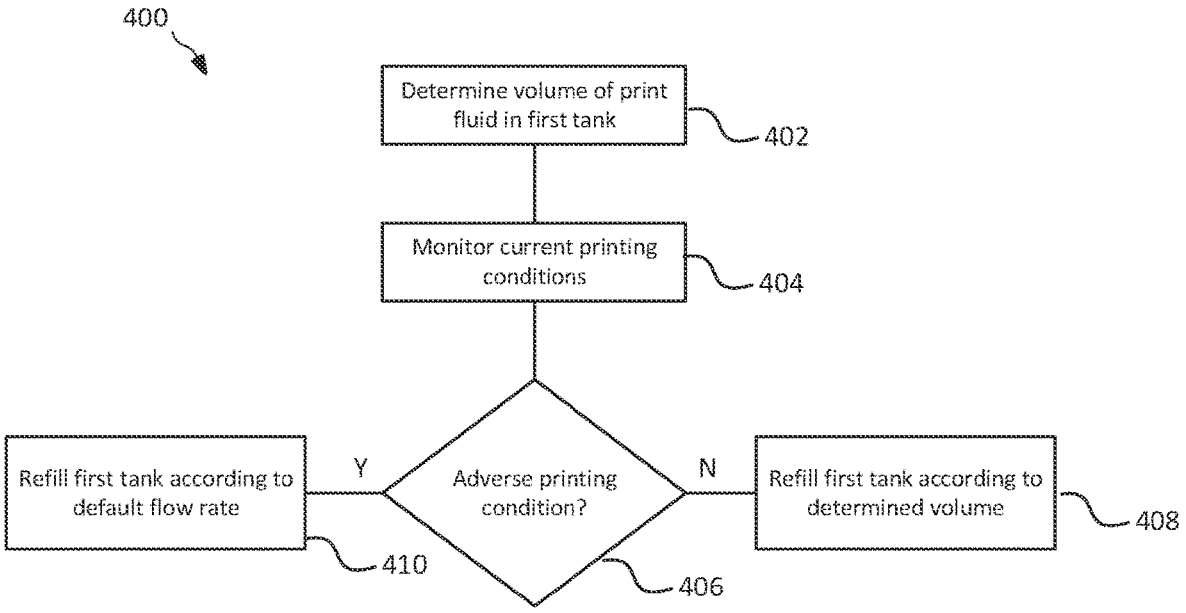
FIG. 4 is a flow diagram of a method in accordance with various examples.

FIG. 4 is a flowchart of an example method 400. In at least some examples, the method 400 is implemented by a controller of an electronic device, such as the control board 112 of the printer 102 of FIG. 1. Accordingly, reference may be made to components of FIG. 1 in describing the method 400. In at least some examples, the method 400 is a method for performing refilling of the intermediate tank 106, such as from the tank 104.

At operation 402, the controller determines a volume of print fluid in a first tank of the electronic device. In some examples, the controller determines the volume of print fluid in the first tank based on an output of a pressure sensor, as described above herein.

At operation 404, the controller monitors current printing conditions of the electronic device disposing print fluid on a substrate. In at least some examples, the current printing conditions may include a flux of the electronic device (when the electronic device is a printer), a volume of print fluid being disposed on a substrate by the electronic device, a density of print fluid being disposed on a substrate by the electronic device, etc.

At operation 406, the controller determines, based on the volume of print fluid and the current printing conditions, whether an adverse printing condition exists. In at least some examples, the controller determines that an adverse printing condition (e.g., the existence of an adverse printing condition, as described above herein) exists based on the flux of the electronic device exceeding a threshold. In other examples, the controller determines that an adverse printing condition exists based on a standard deviation of a signal representative of the volume of print fluid in the first tank exceeding a threshold with respect to a previously determined standard deviation. If the controller determines that the adverse printing condition does not exist, the method 400 proceeds to operation 408.

At operation 408, responsive to the volume of print fluid being less than a threshold and the adverse printing condition not existing, the controller controls a pump to refill the first tank from a second tank at a flow rate determined at least partially according to the determined volume of print fluid.

Returning to operation 406, if the controller determines that the adverse printing condition exists, the method 400 proceeds to operation 410. At operation 410, responsive to the volume of print fluid being less than the threshold and the adverse printing condition existing, the controller controls the pump to refill the first tank from the second tank at a default flow rate determined independent of the determined volume of print fluid. In at least some examples, the default flow rate may be the known good flow rate, as described above herein.

Figure 5:
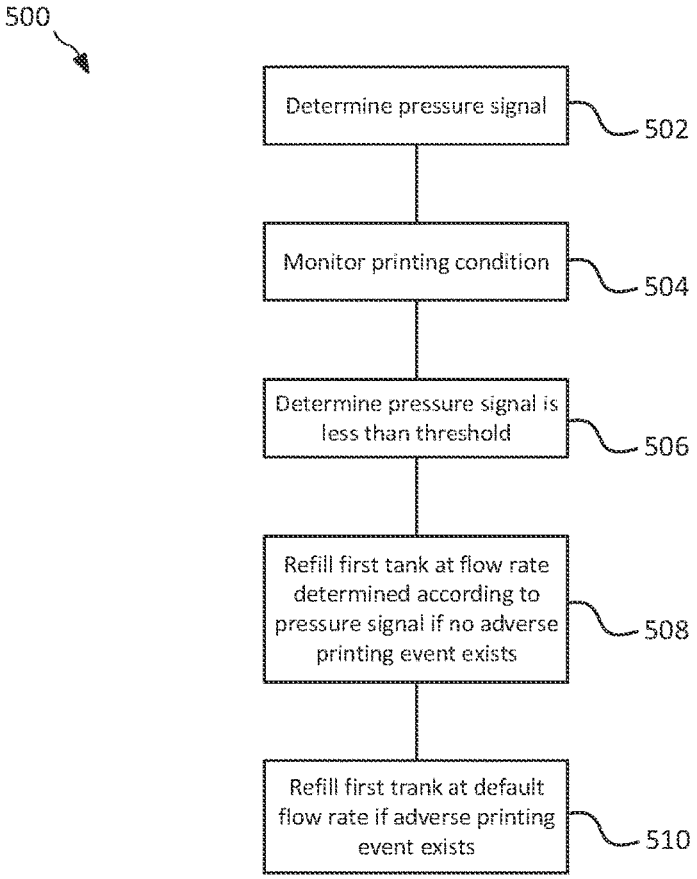
FIG. 5 is a flow diagram of a method in accordance with various examples.

FIG. 5 is a flowchart of an example method 500. In at least some examples, the method 500 is implemented by a controller of an electronic device, such as the control board 112 of the printer 102 of FIG. 1. Accordingly, reference may be made to components of FIG. 1 in describing the method 500. In at least some examples, the method 500 is a method for performing refilling of the intermediate tank 106, such as from the tank 104.

At operation 502, a pressure signal representative of a volume of print fluid in a first tank is determined. The pressure signal may be determined, for example, by the controller monitoring a pressure sensor coupled to, integrated into, or otherwise associated with, the first tank.

At operation 504, printing conditions of a print system are monitored. In some examples, the printing conditions include at least an amount of print fluid being output by the print system. The printing conditions may be monitored, for example, by the controller monitoring a densitometer coupled to, integrated into, or otherwise associated with, a print head that outputs print fluid in the print system (e.g., such as by disposing or otherwise applying the print fluid to a substrate).

At operation 506, a determination is made that the pressure signal has a value less than a threshold. In at least some examples, the threshold is a threshold for beginning refilling of the intermediate tank.

At operation 508, the first tank is refilled from a second tank at a flow rate determined at least partially according to the pressure signal responsive to the printing conditions indicating an adverse printing event does not exist and the pressure signal having the value less than the threshold.

At operation 510, the first tank is refilled from the second tank at a flow rate determined independent of the pressure signal responsive to the printing conditions indicating an adverse printing event exists and the pressure signal having the value less than the threshold. In at least some examples, the flow rate determined independent of the pressure signal may be the known good flow rate, as described above herein.

Figure 6:
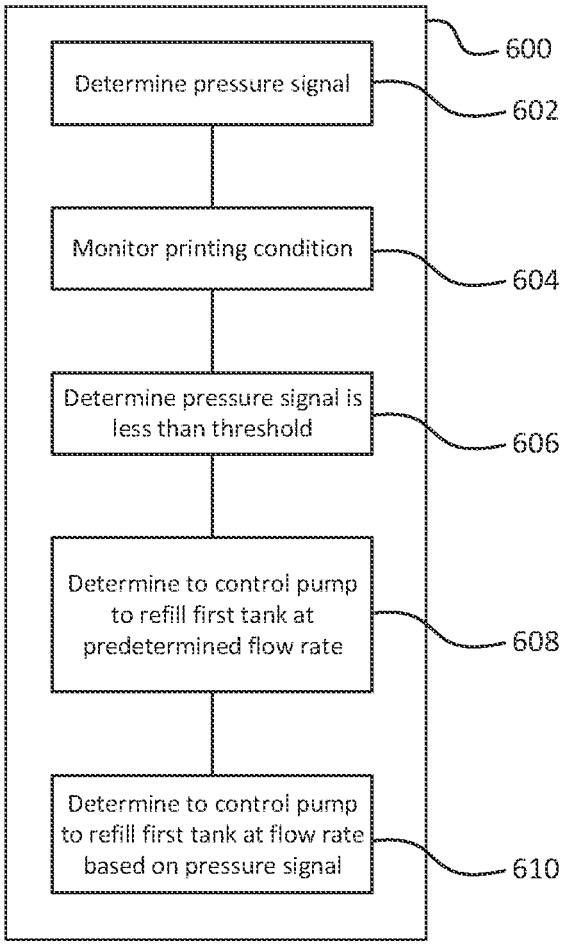
FIG. 6 is a block diagram of a computer-readable medium in accordance with various examples.

FIG. 6 is a diagram of a computer-readable medium 600 storing executable code. In at least some examples, the computer-readable medium is non-transitory in nature and the executable code is machine-executable. When executed, such as by a controller, such as the control board 112 of FIG. 1, of an electronic device, the executable code causes the controller to perform functions or operations. In at least some examples, the executable code is representable as instructions.

In at least some examples, instruction 602 causes the controller to determine a pressure signal representative of a volume of print fluid in a first tank. The pressure signal may be determined, for example, by the controller monitoring a pressure sensor coupled to, integrated into, or otherwise associated with, the first tank.

In at least some examples, instruction 604 causes the controller to monitor printing conditions of the electronic device to determine whether the printing conditions indicate an adverse printing event. In some examples, the printing conditions include at least an amount of print fluid being output by the print system. The printing conditions may be monitored, for example, by the controller monitoring a densitometer coupled to, integrated into, or otherwise associated with, a print head that outputs print fluid in the print system (e.g., such as by disposing or otherwise applying the print fluid to a substrate).

In at least some examples, instruction 606 causes the controller to determine that the pressure signal is less than a threshold. In at least some examples, the threshold is a threshold for beginning refilling of an intermediate tank from an external tank, such as a large volume or high capacity.

In at least some examples, instruction 608 causes the controller to, responsive to existence of the adverse printing event and the pressure signal being less than the threshold, determine to control a pump to refill the first tank at a pre-determined flow rate determined independent of the pressure signal. In at least some examples, the flow rate determined independent of the pressure signal may be the known good flow rate, as described above herein. In some examples, instruction 608 also causes the controller to control the pump to refill the first tank at the predetermined flow rate determined independent of the pressure signal In at least some examples, instruction 610 causes the controller to, responsive to the adverse printing event not existing and the pressure signal being less than the threshold, determine to control the pump to refill the first tank at a flow rate determined based on the pressure signal. In some examples, instruction 610 also causes the controller to control the pump to refill the first tank at the flow rate determined based on the pressure signal.

The above discussion is meant to be illustrative of the principles and various examples of the disclosure. Numerous variations and modifications of the described examples are contemplated. It is intended that the following claims be interpreted to embrace all such variations and modifications.

What is claimed is:

1. An electronic device, comprising:

a controller to:

determine a volume of print fluid in a first tank of the electronic device;

monitor current printing conditions of the electronic device disposing print fluid on a substrate;

determine, based on the volume of print fluid and the current printing conditions, whether an adverse printing condition exists;

responsive to the volume of print fluid being less than a threshold and the adverse printing condition not existing, control a pump to refill the first tank from a second tank at a first flow rate determined at least partially according to the determined volume of print fluid; and responsive to the volume of print fluid being less than the threshold and the adverse printing condition existing, control the pump to refill the first tank from the second tank at a default flow rate different from the first flow rate, the default flow rate determined independent of the determined volume of print fluid.

2. The electronic device of claim 1, wherein the controller is to monitor the current printing conditions based on an output of a densitometer.

3. The electronic device of claim 1, wherein the default flow rate determined independent of the determined volume of print fluid is a flow rate pre-programmed to the controller by a manufacturer of the electronic device.

4. The electronic device of claim 1, wherein the controller is to determine the volume of print fluid in the first tank of the electronic device according to a measured pressure of the print fluid in the first tank.

5. The electronic device of claim 1, wherein the adverse printing condition exists responsive to the current printing conditions indicating that a volume of print fluid from the first tank being disposed on a substrate exceeds a second threshold.

6. The electronic device of claim 1, wherein the adverse printing condition produces a false indication of the volume of print fluid in the first tank.

7. The electronic device of claim 6, wherein the adverse printing condition corresponds to a sustained print fluid flux exceeding a threshold.

8. The electronic device of claim 6, wherein the adverse printing condition corresponds to a standard deviation of a measured pressure applied by the print fluid in the first tank exceeding a threshold.

9. The electronic device of claim 6, wherein responsive to the volume of print fluid being less than the threshold and the adverse printing condition existing, the controller is to modify an automatic ink refilling process for the first tank.

10. A method, comprising:

determining a pressure signal representative of a volume of print fluid in a first tank;

monitoring printing conditions of a print system, the printing conditions including at least an amount of print fluid being output by the print system;

determining that the pressure signal has a value less than a threshold;

refilling the first tank from a second tank at a flow rate determined at least partially according to the pressure signal responsive to the printing conditions indicating an adverse printing event does not exist and the pressure signal having the value less than the threshold; and refilling the first tank from the second tank at a flow rate determined independent of the pressure signal responsive to the printing conditions indicating an adverse printing event and the pressure signal having the value less than the threshold.

11. The method of claim 10, wherein the flow rate determined independent of the pressure signal is a flow rate pre-programmed by a manufacturer of the print system.

12. The method of claim 10, comprising providing an indication of print fluid consumed in the refilling, the indication being of calculated print fluid consumed responsive to the first tank being refilled according to the flow rate determined at least partially according to the pressure signal and the indication being of estimated print fluid consumed responsive to the first tank being refilled according to the flow rate determined independent of the pressure signal.

13. The method of claim 10, wherein the first tank is refilled from the second tank in multiple pump cycles and the method is performed for each pump cycle of the multiple pump cycles.

14. The method of claim 13, wherein the adverse printing condition is further determined to exist responsive to a standard deviation of the pressure signal from one of the multiple pump cycles to a next one of the multiple pump cycles exceeding a threshold amount.

15. A computer-readable medium storing executable code, which, when executed by a controller of an electronic device, causes the controller to:

determine a pressure signal representative of a volume of print fluid in a first tank;

monitor printing conditions of the electronic device to determine whether the printing conditions indicate an adverse printing event;

determine that the pressure signal is less than a threshold;

responsive to existence of the adverse printing event and the pressure signal being less than the threshold, determine to control a pump to refill the first tank at a predetermined flow rate determined independent of the pressure signal; and responsive to the adverse printing event not existing and the pressure signal being less than the threshold, determine to control the pump to refill the first tank at a flow rate determined based on the pressure signal.

16. The computer-readable medium of claim 15, wherein the executable code further causes the controller to:

responsive to existence of the adverse printing event and the pressure signal being less than the threshold, control the pump to refill the first tank at the pre-determined flow rate determined independent of the pressure signal; and responsive to the adverse printing event not existing and the pressure signal being less than the threshold, control the pump to refill the first tank at the flow rate determined based on the pressure signal.

17. The computer-readable medium of claim 16, wherein the executable code further causes the controller to provide an indication of print fluid consumed in the refilling, the indication being of calculated print fluid consumed responsive to the first tank being refilled according to the flow rate determined at least partially according to the pressure signal and the indication being of estimated print fluid consumed responsive to the first tank being refilled according to the flow rate determined independent of the pressure signal.

18. The computer-readable medium of claim 15, wherein the flow rate determined independent of the pressure signal is a flow rate pre-programmed to the controller by a manufacturer of the electronic device.

19. The computer-readable medium of claim 15, wherein the first tank is refilled from the second tank in multiple pump cycles and the executable code further causes the controller to determine whether the adverse printing event exists for each pump cycle of the multiple pump cycles.

* * * * *